US005511987A

United States Patent [19]

Shinchi

[11] Patent Number: 5,511,987

[45] Date of Patent: Apr. 30, 1996

[54] WATERPROOF ELECTRICAL CONNECTOR

[75] Inventor: Akira Shinchi, Shizuoka, Japan

[73] Assignee: Yazaki Corporation, Tokyo, Japan

[21] Appl. No.: 272,610

[22] Filed: Jul. 11, 1994

[30] Foreign Application Priority Data

Jul. 14, 1993 [JP] Japan ..... 5-174050

[51] Int. Cl.[6] ..... H01R 4/00

[52] U.S. Cl. ..... 439/205; 439/271

[58] Field of Search ..... 439/205, 206, 439/271, 272, 274, 275, 357, 358, 589

[56] References Cited

U.S. PATENT DOCUMENTS

| | | | |
|---|---|---|---|
| 5,334,039 | 8/1994 | Kanda | 439/271 |
| 5,336,102 | 8/1994 | Cairns et al. | 439/272 |
| 5,356,304 | 10/1994 | Colleran | 439/205 |

FOREIGN PATENT DOCUMENTS 55-46827 3/1980 Japan .

2-49657 12/1990 Japan .

*Primary Examiner*—Khiem Nguyen

*Attorney, Agent, or Firm*—Finnegan, Henderson, Farabow, Garrett & Dunner

[57] ABSTRACT

There is provided a waterproof electrical connector including a male connector housing and a female connector housing for connection with the male connector housing. A hood portion is provided on one of the male connector housing and the female connector housing. A packing within the hood portion provides a waterproof seal for the connector. A packing press ring presses against and retains the packing within the hood portion. Vent hole portions are provided on a portion of the packing press ring that is abutted against the packing. During connection of the male connector housing with the female connector housing, compressed air exits via the vent hole portions. Thereby, an impingement sound or a touch feeling is strongly produced so that, during assembly, an operator easily detects whether the connector housings are in a fitted condition or a non-fitted condition.

4 Claims, 6 Drawing Sheets

WATERPROOF ELECTRICAL CONNECTOR

BACKGROUND OF THE INVENTION

1. Field of the Invention

The present invention relates to a waterproof connector. More particularly, the present invention relates to a waterproof electrical connector in which, during connection of the male and female connector housings, compressed air exits and an impingement sound or touch feeling is produced.

2. Discussion of the Related Art

One conventional electrical connector includes a bolt for supplying the tightening force to connect female and male connector housings together. A second conventional waterproof electrical connector includes a lever, as shown in FIGS. 5 through 8. This conventional connector includes a male connector housing c1 having a pair of female terminals a, and a female connector housing c2 having a pair of male terminals b. The female connector housing c2 has a hood portion d for receiving the male connector housing c1. A packing e is fitted in the hood portion d. A packing press ring f of a substantially tubular shape is pressed at its one end against the packing e. The packing e is intimately fitted against an outer peripheral surface q of the male connector housing c1 to achieve a waterproof connection.

This conventional lever type waterproof connector further includes a pivotally-movable lever R mounted on the female connector housing c2, as shown in FIG. 8. The male connector housing c1 has pins i to engage cam grooves formed in the lever R.

In either type of conventional electrical connector, whether the connector housings c1 and c2 are in a fitted condition, a non-fitted condition, or a provisionally-fitted condition can be detected through an impingement sound or a touch feeling produced when the connector housings c1 and c2 are fitted together. Thus, an operator on a production line can detect the complete connection of the connector housings.

In the conventional waterproof electrical connector as shown in FIGS. 5 to 8, the waterproof effect is achieved by the packing e pressed and retained by the packing press ring f within the hood portion d. The impingement sound or touch feeling produced when the connector housings c1 and c2 are fitted together is weakened by a cushioning effect due to an elastic force of the packing e produced when the connector housings are fitted together.

Also, the interior of the waterproof electrical connector must be sealed for waterproof purposes when the pair of connector housings c1 and c2 are fitted together. Therefore, the air within the connector housings c1 and c2 is compressed during the fitting operation. The compression resists the fitting force, requiring additional time and fitting force to connect the connector housings c1 and c2 together. The impingement sound is further weakened by this compressive force.

Therefore, due to the cushioning effect produced by the packing e and the compressive force during connection, an operator has difficulty determining whether the connector housings c1 and c2 are completely connected. Often, incomplete, erroneous connections occur.

SUMMARY OF THE INVENTION

The present invention has been made in view of the above circumstances and has as an object to provide a waterproof electrical connector in which a strong impingement sound or touch feeling is produced when female and male connector housings are fitted together. Accordingly, during an assembling operation, an operator can easily and positively know whether the connector housings are in a completely connected condition.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the waterproof electrical connector of this invention comprises a male connector housing and a female connector housing for connection with the male connector housing. A hood portion is provided on one of the male connector housing and the female connector housing. A packing within the hood portion provides a waterproof seal for the connector. A packing press ring presses against and retains the packing within the hood portion. Vent hole portions are provided on a portion of the packing press ring that is abutted against the packing. During connection of the male connector housing with the female connector housing, compressed air exits via the vent hole portions.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawings.

DESCRIPTION OF THE PREFERRED EMBODIMENT OF THE INVENTION

The waterproof electrical connector according to the present invention includes a pair of connector housings with male and female electrical terminals to be fitted together. One connector housing has a hood portion for receiving the other connector housing. A packing fitted in the hood portion is pressed by one end of a packing press ring and is adapted to intimately fit on an outer peripheral surface of the other connector housing. The packing provides a waterproof seal for the electrical connection within the connector.

Vent hole portions for compressed air relief are formed in a portion of the packing press ring abutted against the packing. Therefore, when the connector housings are fitted together, the air within the two connector housings is discharged to the exterior through the vent hole portions. Thereby, the compressive force attendant during connection of conventional electrical connectors is limited and the fitting of the connector housings can be rapidly performed and positively detected as an impingement sound is sufficiently produced.

An embodiment of the waterproof electrical connector according to the present invention will be described with reference to FIGS. 1 to 4. The connector includes a male connector housing 1 having female electrical terminals 2 provided therein. A female connector housing 3 has male electrical terminals 4 provided therein.

Figure 4:
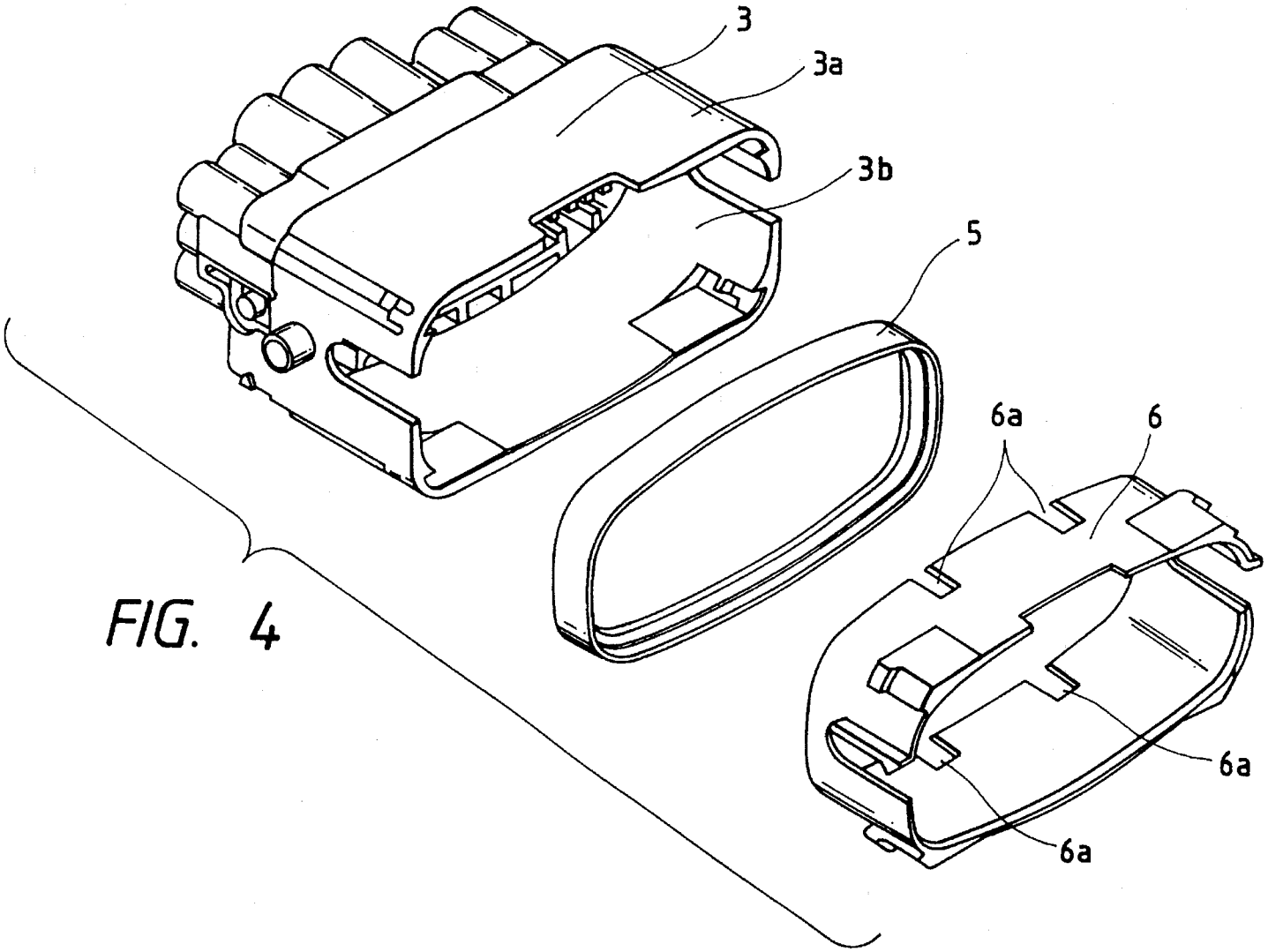
FIG. 4 is an exploded perspective view of the female connector housing shown in FIG. 3.
Figure 5:
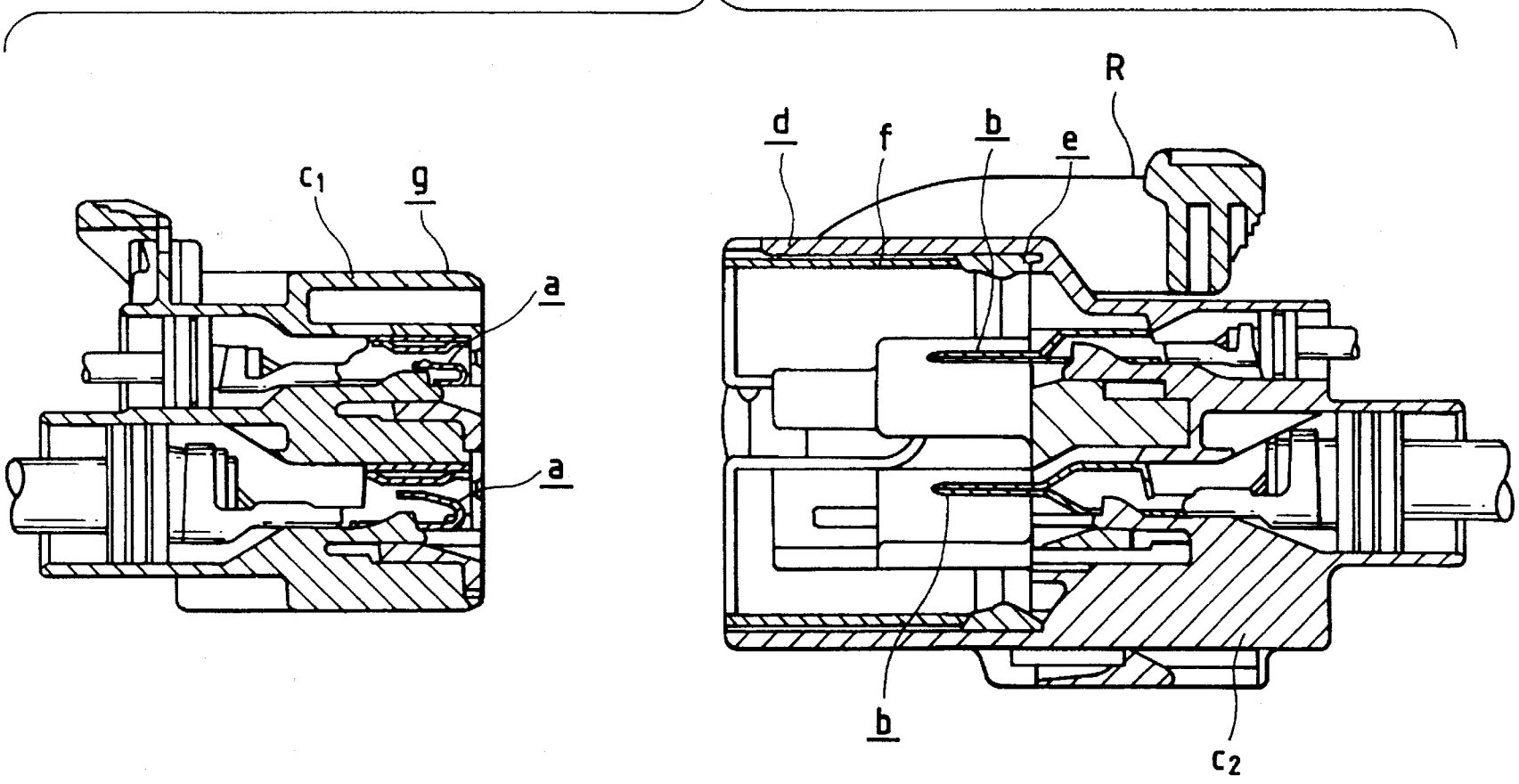
FIG. 5 is a cross-sectional view of a conventional waterproof electrical connector showing a pair of connector housings in a non-fitted condition.
Figure 6:
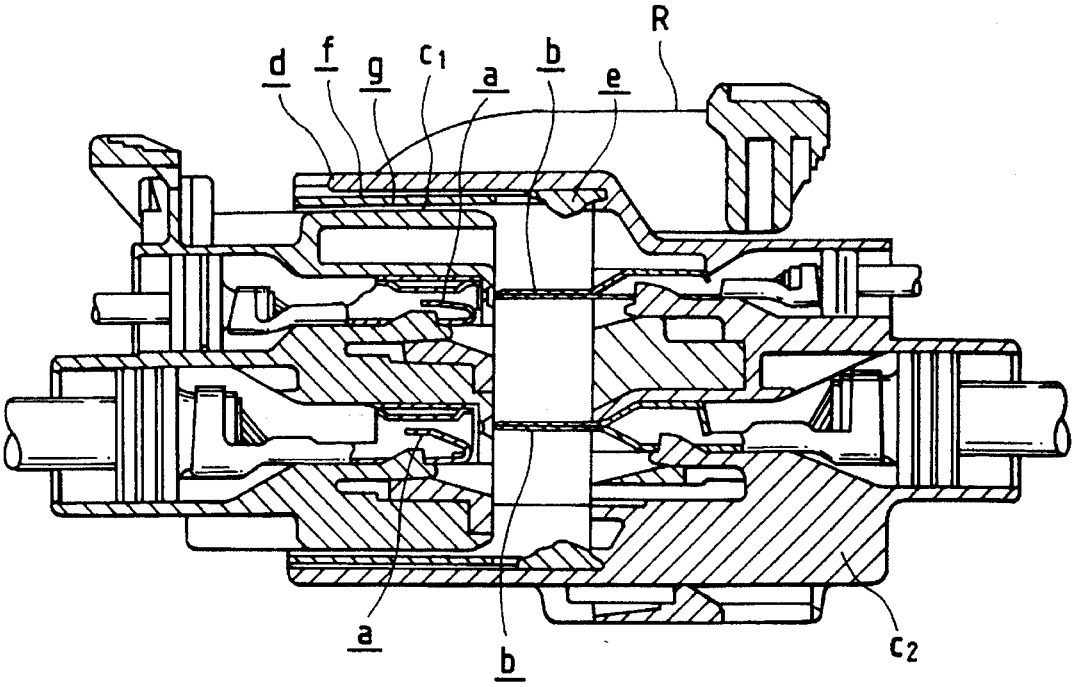
FIG. 6 is a cross-sectional view of the conventional connector of FIG. 5 showing the connector housings in a fitted condition.
Figure 8:
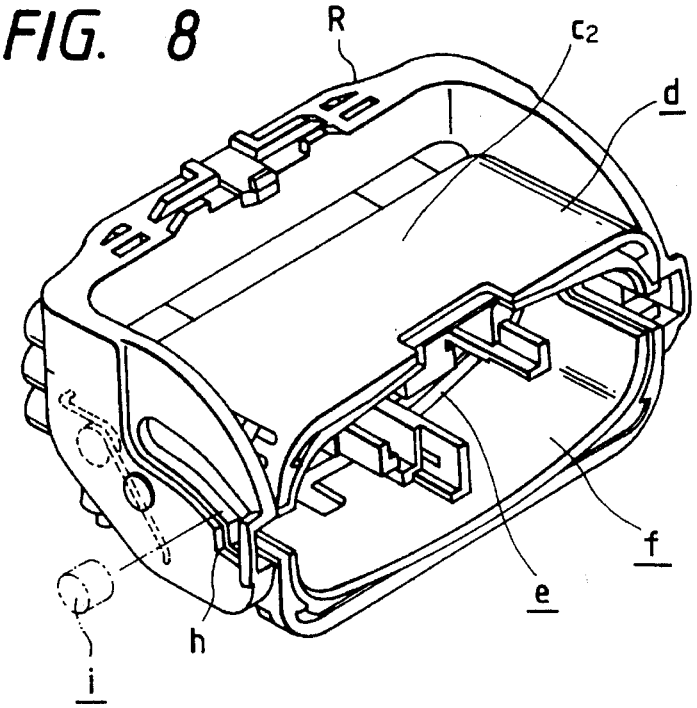
FIG. 8 is a perspective view of the female connector housing shown in FIG. 7 in its assembled condition.
Figure 7:
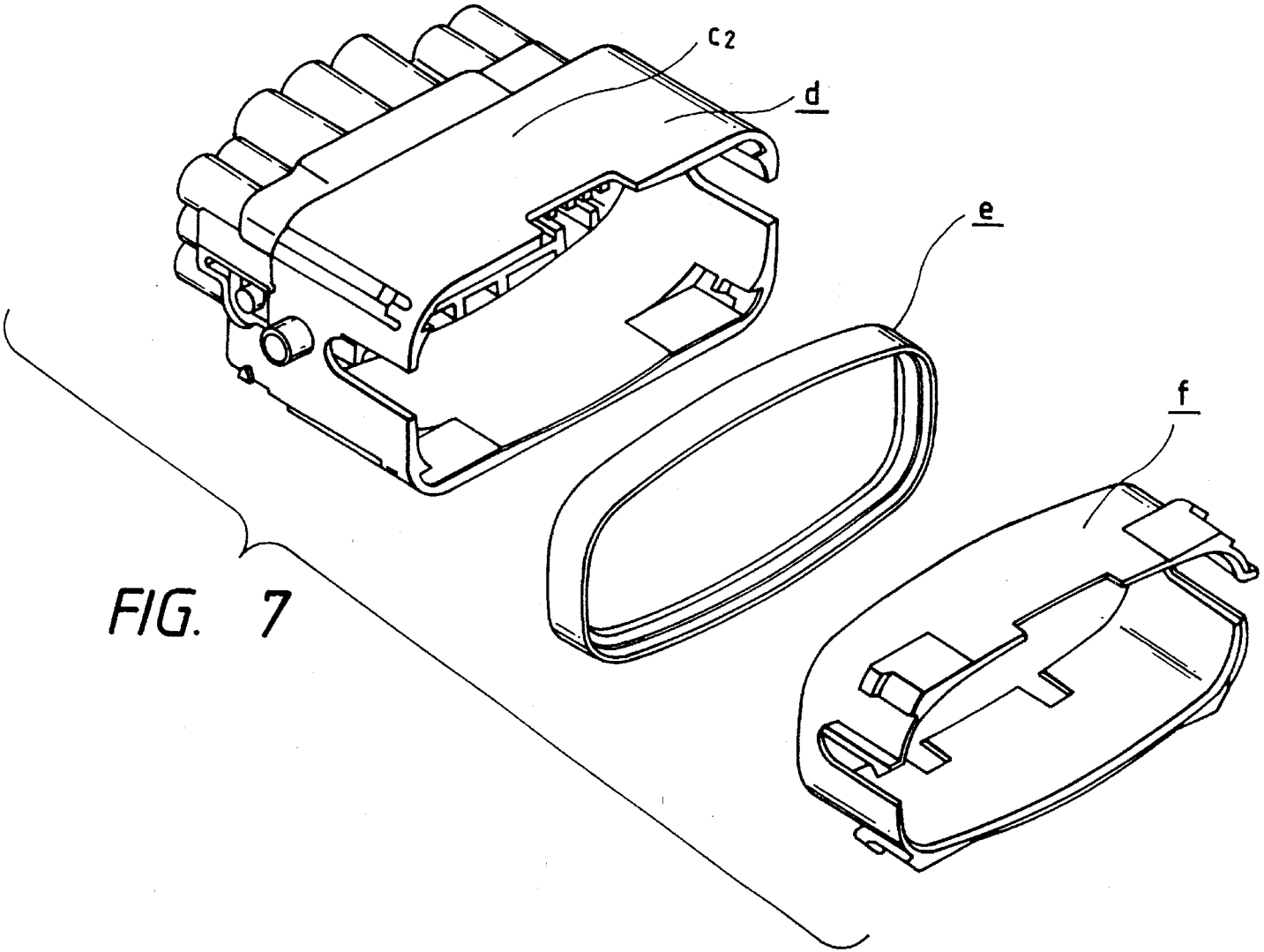
FIG. 7 is an exploded perspective view of the female connector housing of the conventional waterproof electrical connector of FIG. 5.

For connecting the male and female connector housings 1 and 3 together, the female connector housing 3 has at its front a hood portion 3*a* of a larger diameter than the connector housings. The hood portion 3*a* has an opening 3*b* therein for receiving the male connector housing 1. A generally annular packing 5, as most clearly shown in FIG. 4, is mounted in the opening 3*b*. The packing 5 is pressed and retained against the hood portion 3*a* by one end of a generally tubular packing press ring 6. The packing 5 intimately fits on an outer peripheral surface 1*a* of the male connector housing 1, thereby achieving a waterproof seal.

The waterproof electrical connector as embodied herein further includes seal plugs 7 and 7' of a generally annular shape, and wires 8 and 8' connected to the female electrical terminals 2 within the male connector housing 1. The seal plugs provide a watertight seal for the female electrical terminals 2 in the connector housing 1.

Similarly, the female connector housing includes seal plugs 9 and 9' and wires 10 and 10'. The wires 10 and 10' are connected to the male electrical terminals 4 within the female connector housing 3. Seal plugs 9 and 9' provide a watertight seal for the male electrical terminals 4 within the connector housing 3.

The waterproof connector according to the present invention and as embodied in FIGS. 1 to 4 further includes a suitable number of vent hole portions 6*a* formed through the portion of the packing press ring 6 abutted against the packing 5. The vent hole portions 6*a* provide compressed air relief during connection of the male and female connector housings. The air inside the connector housings 1 and 3 compresses when they are fitted together. The compressed air discharges to the exterior through a gap between an inner peripheral surface of the hood portion 3*a* and the packing press ring 6, as indicated by arrows A in FIG. 2. If the compressed air produces a large resistance during the fitting of the connector housings 1 and 3, the connection can be performed more rapidly and without as much fitting force as compared to conventional electrical connectors.

Figure 1:
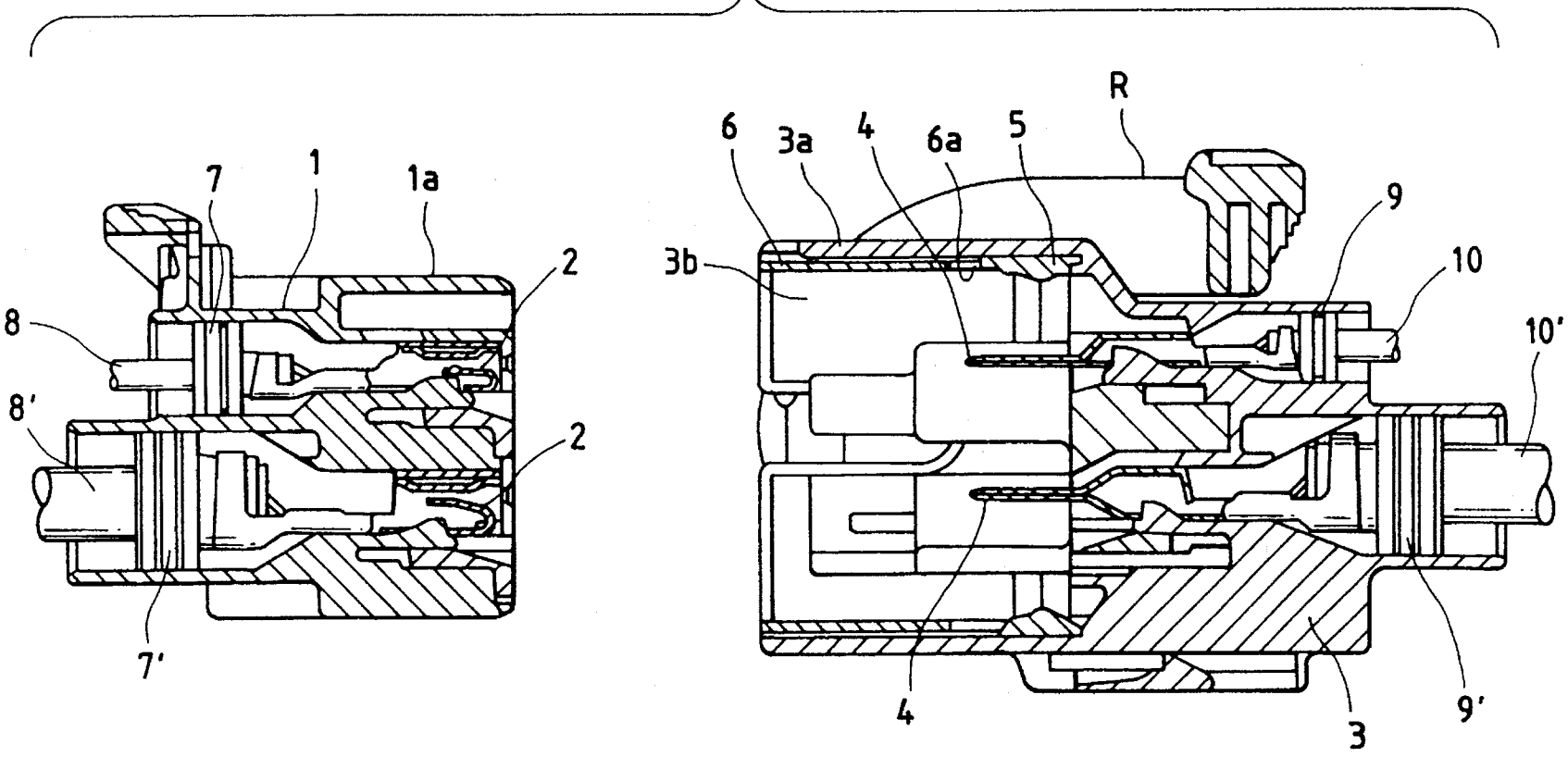
FIG. 1 is a cross-sectional view of one embodiment of a waterproof electrical connector according to the present invention showing a pair of connector housings in a non-fitted condition.
Figure 2:
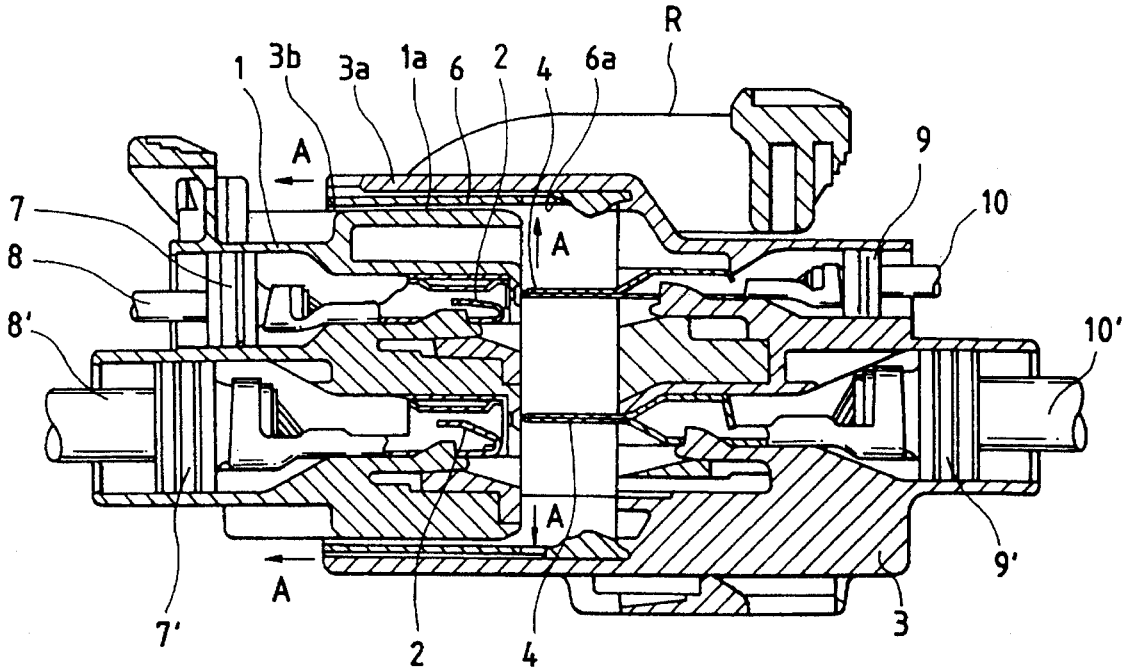
FIG. 2 is a cross-sectional view of the waterproof electrical connector of FIG. 1 showing the pair of connector housings in a fitted condition.
Figure 3:
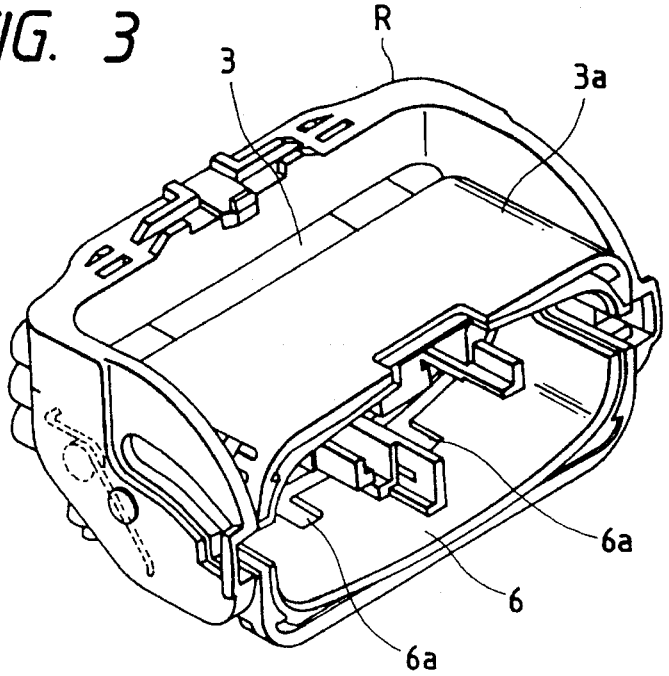
FIG. 3 is a perspective view of the female connector housing of the waterproof electrical connector of FIG. 1.

When the male and female connector housings 1 and 3 go from a non-fitted condition (FIG. 1) to a completely-fitted condition (FIG. 2), the connection produces an impingement sound or a touch feeling. As the compressive force is less than in conventional connectors, the impingement sound or touch feeling is not weakened. Thus, whether or not the connector housings 1 and 3 are completely connected is more easily detected. Upon the application of a fitting force either by the tightening force of a bolt or by the pivotal movement of a lever R as shown in FIGS. 1 to 3, if the connector housings 1 and 3 do not produce an impingement sound, they are insufficiently connected and in the non-fitted condition. Therefore, during assembly and connection, the operator more easily and confidently knows whether or not the male and female connector housings 1 and 3 are fitted together. Higher reliability of the connection is achieved.

In summary and as described hereinabove, in the waterproof electrical connector according to the present invention, when the pair of connector housings are fitted together, the air within the pair of connector housings is discharged to the exterior. The air exits through the vent hole portions and along the inner periphery of the hood portion. The vent hole portions are formed in the portion of the packing press ring abutted against the packing. The exiting of the air lessens the compressive force and resistance supplied when connecting the male and female connector housings. Thereby, when the connector housings are fitted together, an impingement sound or a touch feeling is strongly produced. The operator easily and positively detects whether the pair of connector housings are in the fitted condition or the non-fitted condition.

The foregoing description of the preferred embodiment of the invention has been presented for purposes or illustration and description. It is not intended to be exhaustive or to limit the invention to the precise form disclosed, and modifications and variations are possible in light of the above teachings or may be required from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A waterproof electrical connector comprising:

a male connector housing;

a female connector housing for connection with the male connector housing;

a hood portion provided on one of the male connector housing and the female connector housing;

a packing within the hood portion to provide a waterproof seal for the connector;

a packing press ring pressing against and retaining the packing within the hood portion; and vent hole portions provided on a portion of the packing press ring that is abutted against the packing, wherein during connection of the male connector housing with the female connector housing, compressed air exits via the vent hole portions.

2. The waterproof electrical connector according to claim 1, wherein the compressed air exits via a gap between an inner surface of the hood portion and an outer surface of the packing press ring.

3. The waterproof electrical connector according to claim 1, wherein during connection of the male connector housing with the female connector housing, an impingement sound is produced.

4. The waterproof electrical connector according to claim 1, further including:

male electrical terminals within the female connector housing; and female electrical terminals within the male connector housing for connection with the male electrical terminals.

* * * * *